United States Patent [19]

Benjamin

[11] 4,100,634

[45] Jul. 18, 1978

[54] WATER MATTRESS CONSTRUCTION

[75] Inventor: Gary L. Benjamin, Mount Blanchard, Ohio

[73] Assignee: Kuss Corporation, Findlay, Ohio

[21] Appl. No.: 729,906

[22] Filed: Oct. 6, 1976

[51] Int. Cl.[2] ..... A47C 23/02; A47C 23/04

[52] U.S. Cl. ..... 5/365

[58] Field of Search ..... 229/40, 87 R, 424; 5/365

[56] References Cited

U.S. PATENT DOCUMENTS

| | | | |
|---|---|---|---|
| 2,011,703 | 8/1935 | Barker | 206/424 |
| 3,381,889 | 5/1968 | Laskow | 229/40 |
| 3,682,370 | 8/1972 | Rous | 206/424 |
| 3,753,823 | 8/1923 | Kuss | 5/367 |

*Primary Examiner*—Philip C. Kannan

*Attorney, Agent, or Firm*—Vincent L. Barker, Jr.; David D. Murray

[57] ABSTRACT

A water mattress construction is disclosed. The construction involves a folded one piece vinyl sheet wherein the various panels are joined at the vertical corners, along the lengthwise lower edges and side to side across the middle of the bottom. By so locating the seams, not only are all but the vertical corner seams supported directly by the mattress frame, but they are also removed from the upper area of the mattress which is generally subjected to flexing. A cappable fitting to facilitate filling and emptying of the mattress is included. The various panels are joined by overlapping the vinyl material, and subsequently heat-sealing them to produce strong lapped seams throughout.

1 Claim, 3 Drawing Figures

WATER MATTRESS CONSTRUCTION

BACKGROUND OF THE INVENTION

The invention relates to water beds, and more particularly to an improved water mattress construction wherein all seams except the vertical corner seams are at or on the lower face of the water mattress and thus supported completely by the mattress frame which may comprise a deck or other rigid support.

A water mattress construction is shown in U.S. Pat. No. 3,952,348. In such construction, the mattress is folded from a sheet of vinyl which is substantially equal to the length and the girth of the completed water mattress. Such a construction results in four vertical seams at the corners, a lengthwise seam approximately centered on the bottom face and two horizontal seams approximately centered on the head and toe vertical ends.

Another early water mattress coonstruction is disclosed in U.S. Pat. No. 3,753,823. In this construction, the mattress is folded from an elongate vinyl sheet which is essentially double the length of the vinyl mattress, in such a way that there results one vertical side with no seam, the remaining three sides having a full-length horizontal seam that is approximately vertically centered, and four vertical corner seams.

The difficulty with both constructions is two-fold. They produce a water mattress with seams which are unsupported by the water mattress frame and support structure. And, because the seams are on the side walls relatively near the upper surface of the mattress, they will be depressed, flexed, and wrinkled when a person sits or reclines on the mattress. It has been found that this continued wrinkling of the side seams can result in their failure after a prolonged period of use.

When a water mattress fails and leakage occurs, the failure point is nearly always located on one of the side seams which is subjected to wrinkling and deformation caused by persons sitting or reclining on the water mattress. It is believed that the reason for such failures is related to a repeated pattern of wrinkle formation in the vinyl material, wherein the wrinkles extend down from the upper surface of the mattress to the seam and often remain in the material. If the sitting is repeated over a period of time, the wrinkling tends to follow a certain pattern. The repeated wrinkling pattern, together with the aging of the vinyl material and the gradual loss by evaporation or other means of plasticizers therefrom, results in a fatiguing of the vinyl material and either separation or rupture of the material at the seam.

SUMMARY OF THE INVENTION

The present invention is a water mattress construction which eliminates all horizontal side seams which are subject to wrinkling and eventual failure and locates them on the bottom face of the mattress which in a normal installation would be completely supported and contained by a flat surface having a shape and area which is substantially equal to that of the filled water mattress and which includes a raised edge around its perimeter which retains the water mattress on the support. The only remaining vertical seams are those in the four corners, and they comprise a continuous lapped joint assembled from only two pieces of vinyl material which constitute the intersecting sides.

The water mattress is folded from a single sheet of vinyl which is initially essentially double the length of the mattress. Accordingly, the mattress is folded into a three-dimensional rectangular solid configuration by folding along lines which are perpendicular to the length of the finished water mattress. The mattress is sealed along the two longitudinal bottom seams and one transverse bottom seam located approximately in the middle of the mattress, preferably in a lap seam. The vertical corners are then brought together and lap seamed to form the finished rectangular box configuration. These seams are formed by using access openings according to the teachings of U.S. Pat. No. 3,753,823. The access openings, including that which is eventually covered with a fill and drain fitting, may each be located in one of several locations, depending upon the location of the transverse mattress seam.

The water mattress construction, according to the present invention, is a stronger, more durable and failure-resistant mattress which is the result of placing all but the four corner vertical seams on the bottom face of the water mattress frame. The flexing and wrinkling to which the seams are subjected during the life of the water mattress will be at an absolute minimum.

In addition to the improved life, which a water mattress constructed according to the present invention will provide, the elimination of all horizontal seams on the side surfaces produces a mattress which will not trap dirt and other foreign objects along these horizontal seams, and is therefore easier to keep clean.

DESCRIPTION OF THE PREFERRED EMBODIMENT

Figure 1:
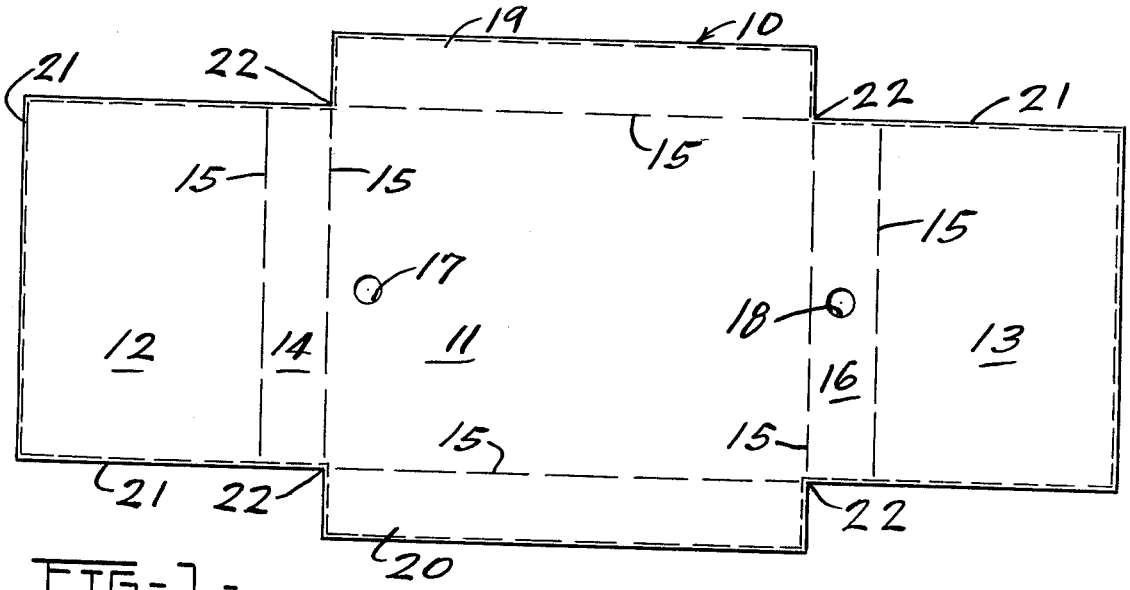
FIG. 1 is a plan view showing a developed sheet of material to be used in producing a water mattress according to the invention.

In the drawings, FIG. 1 shows a sheet of water mattress material 10, preferably vinyl chloride, in a flat, developed layout as it appears when it is initially cut. As seen in the drawings, the sheet 10 is somewhat more than double the length of the finished mattress, with areas 11, 12, and 13 indicating the top surface and toe end and head end of the bottom surface, respectively. Intermediate areas 14 and 16 form the toe and head vertical sides of the assembled water mattress. Dashed lines 15 indicate where the sheet of material 10 is to be folded. Access openings 17 and 18 are included in the sheet 10 for performing the final sealing of the seams. The opening 17 on the top surface 11 of the sheet will ultimately receive a valved water filling and air outlet fitting, while the access opening 18 on the vertical side at the head of the water mattress will receive a sealing patch following the final sealing operations. The use of the access openings 17 and 18, and the manner in which they are ultimately closed are discussed in the above cited U.S. Pat. No. 3,753,823. Referring again to FIG. 1, the sheet of water mattress material 10 includes left side flap 19 and right side flap 20. Dashed lines 21 indicate the areas of overlap of the side flaps and other edges which are to be assembled together into lap seams in the finished water mattress. Lap seams have much greater resistance to stress than do fin type seams.

Notched corners 22 represent the four corners on the upper surface of the water mattress where the vertical lapped seams begin.

Figure 2:
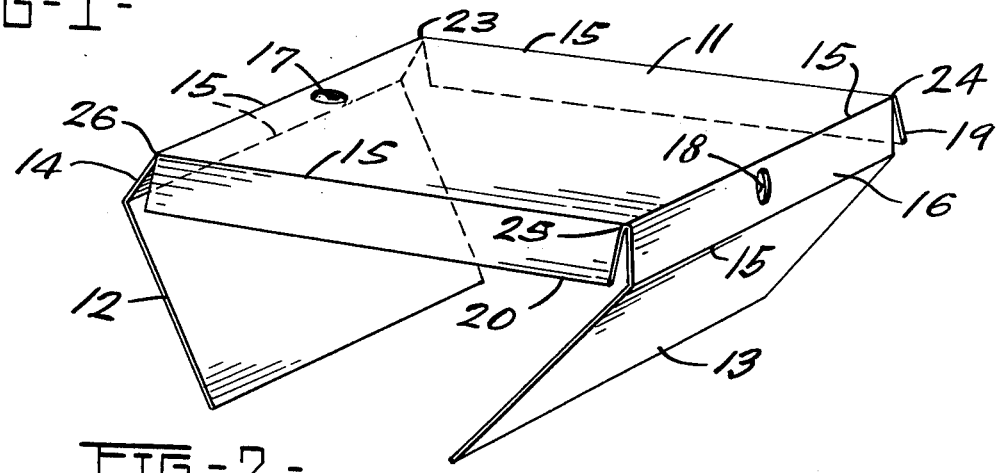
FIG. 2 is a perspective view showing the material of the water mattress in a semi-folded and semi-assembled condition.

Referring now to FIG. 2, the direction of folding along lines 15 can be clearly seen. From the orientation of the material as shown in FIG. 1, it is folded downwardly and inwardly along fold lines 15. Areas 12 and 13 form what will be the bottom panel of the water mattress and the intermediate areas 14 and 16 and side flaps 19 and 20 form what will be the sides of the water mattress. The intersection of area 14 and flap 19, when sealed, forms the lower left vertical corner 23; the intersection of flap 19 and area 16, when sealed, forms the upper left vertical corner 24; the intersection of area 16 and flap 20, when sealed, forms the upper right vertical corner 25; and the intersection of area 14 and flap 20, when sealed, forms the lower right vertical corner 26.

Figure 3:
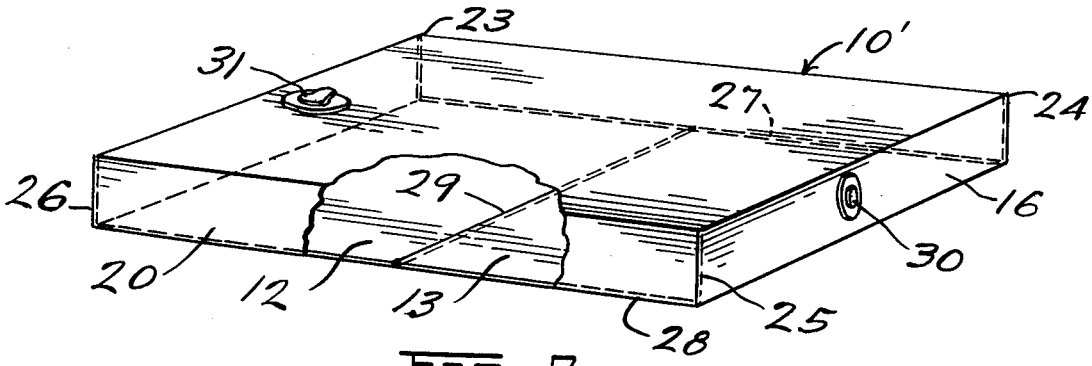
FIG. 3 is a perspective view showing the water mattress folded and sealed together, with a section cut away and the location of the seams indicated.

FIG. 3 shows the water mattress 10' in its assembled configuration. The mattress 10' includes no longitudinal or transverse seams which are not immediately adjacent the bottom areas 12 and 13 and thus, without support from the mattress frame. Rather, the mattress contains four vertical corner seams as just discussed, and two longitudinal seams at the intersection of side flaps 19 and 20 with the bottom areas 12 and 13, and one transverse seam at the intersection of areas 12 and 13; the seam arrangement generally forming an "H" pattern. These seams, preferably lap seams, as well as the vertical corner seams discussed above, are formed according to the teachings of U.S. Pat. No. 3,753,823.

Following the completion of the final seam sealing operations, the access openings 17 and 18 are closed. The opening 18 is preferably closed by a patch 30 sealed thereto, while a combination fill and vent fitting 31 is preferably sealed to the surface of the mattress at opening 17. These operations are also discussed in the above cited patent. The combination fill and vent fitting 31, schematically indicated in FIG. 3, usually comprises a single cappable opening which is large enough to receive a garden hose and simultaneously vent air outwardly.

The water mattress 10' is resistant to fatigue seam failure to an extent not known before in three-dimensional box-shaped water mattresses or water mattresses of other constructions. The repeated pattern of wrinkling from the top surface of a water mattress, outwardly and downwardly towards the sides and bottom cannot be concentrated on the horizontal side seams to eventually cause fatigue and failure of water mattresses constructed according to the present invention because all but the four vertical corner seams are on the bottom surface of the water mattress and thus are directly supported by the mattress frame and are subject to almost no wrinkling and flexing. Rather, the folds extend towards the side and bottom, but dissipate near the bottom of the mattress, partly due to the increased water pressure at the bottom of the mattress and partly due to the additional stability and resistance to motion imparted to the water mattress material by the support frame.

Although this configuration of folds and seams does not result in the construction of a water mattress with the shortest possible total length of seams, the benefits of having nearly all but the four corner seams at the bottom of the water mattress in contact with the support frame more than outweigh the disadvantages of the somewhat longer total seam length.

I claim:

1. A water mattress of three-dimensional, rectangular box-like construction fabricated from a unitary sheet of flexible material, said sheet being contoured to include only a top panel, a pair of vertical side panels integral with and folded downwardly on either side of said top panel, a pair of top and bottom vertical end panels integral with and folded downwardly at either end of said top panel, a first bottom panel portion folded horizontally inwardly from the lower edge of one of said vertical end panels, a second bottom panel portion folded horizontally inwardly from the lower edge of the other of said vertical end panels and in lapped seam engagement with said first bottom panel portion on the underside of the mattress, a lap seam between the adjacent edges of adjacent side and end panels forming the vertical corners of the mattress, lap seams between the adjacent edges of said downwardly folded side panels and the edges of said horizontally and inwardly folded bottom panels, and at least one means within said mattress for filling or evacuating fluid therefrom.

* * * * *